US008282243B2

(12) United States Patent
Uemoto et al.

(10) Patent No.: US 8,282,243 B2
(45) Date of Patent: Oct. 9, 2012

(54) LED LAMP AND LIGHTING DEVICE

(75) Inventors: Takaari Uemoto, Osaka (JP); Masahiro Miki, Osaka (JP); Yasuyuki Ueda, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/380,474

(22) PCT Filed: Mar. 18, 2011

(86) PCT No.: PCT/JP2011/001626

§ 371 (c)(1),
(2), (4) Date: Dec. 22, 2011

(87) PCT Pub. No.: WO2011/145252

PCT Pub. Date: Nov. 24, 2011

(65) Prior Publication Data

US 2012/0113638 A1 May 10, 2012

(30) Foreign Application Priority Data

May 19, 2010 (JP) ..... 2010-114870

(51) Int. Cl.
*F21V 1/00* (2006.01)

(52) U.S. Cl. ..... 362/249.02; 362/236

(58) Field of Classification Search ..... 362/236, 362/246, 249.02

See application file for complete search history.

(56) References Cited

U.S. PATENT DOCUMENTS

| | | | | |
|---|---|---|---|---|
| 2007/0297179 | A1* | 12/2007 | Leung et al. | 362/296 |
| 2009/0268470 | A1 | 10/2009 | Okimura et al. | |
| 2010/0026185 | A1 | 2/2010 | Betsuda et al. | |

FOREIGN PATENT DOCUMENTS

| | | |
|---|---|---|
| JP | 2005-310561 | 11/2005 |
| JP | 2006-156187 | 6/2006 |
| JP | 2007-157690 | 6/2007 |
| JP | 3146124 | 10/2008 |
| JP | 3146124 | 11/2008 |
| JP | 2009-037995 | 2/2009 |
| JP | 2010-086713 | 4/2010 |

* cited by examiner

*Primary Examiner* — David V Bruce

(57) ABSTRACT

Provided is a bulb-type LED lamp 10 configured to diffuse light outward through a globe. The bulb-type LED lamp 10 includes LED modules 22, 24, 28, 30, each having a mounting substrate and LEDs mounted on the mounting substrate, and a base 14 through which power is supplied to the LEDs for light emission. The LED lamp 10 also includes a light diffusing member 58. Among the LED modules 22, 24, 28, 30, the LED module 22 is positioned on an imaginary extension of a central axis X of the base 14, and the light diffusing member 58 is positioned inside the globe 16 to receive light emitted from the LED module 22. The other LED modules 22, 28, 30 are positioned in a vicinity of the LED module 22, tilted to face the light diffusing member 58.

8 Claims, 11 Drawing Sheets

LED LAMP AND LIGHTING DEVICE

TECHNICAL FIELD

The present invention relates to an LED lamp and an illumination device, in particular to an LED lamp suitable as a substitute for an incandescent light bulb.

BACKGROUND ART

Due to a recent demand for resource saving, LED lamps, which have a longer life and require less electricity to work, have been commercialized, and additional research studies are in progress.

Such a bulb-type LED lamp generally has a single mounting substrate and a plurality of LED chips mounted on the mounting substrate, and a circuit unit for lighting the LED chips is housed in an inner space of a housing provided between the back side of the mounting substrate and a base.

When used as a substitute for an incandescent light bulb, the bulb-type LED lamp is required to present the closest possible light distribution characteristics to the incandescent light bulb. Specifically, assume the case where the bulb-type LED lamp is placed to face downward. In this case, the bulb-type LED lamp is required to emit light in a broad range, namely, obliquely backward and laterally, in addition to downward.

However, the light distributed by the bulb-type LED lamp exhibits Lambertian characteristics to be directed strongly along a specific direction, and, by its nature, illuminates a limited area right under the lamp and its neighborhood. To address the problem, a bulb-type LED lamp which includes a globe having an opening near the mounting substrate and covering the entire mounting substrate has been conceived (Patent Literature 1). This LED lamp is designed to yield the broadest possible light distribution range, by making the globe from a translucent milk-white material or the like so that the light emitted from the LEDs (i.e. LED chips) is diffused while it passes through the globe.

According to the above technology, however, the light emitted from the LEDs mostly passes through some sections of the globe ahead of the LEDs due to the Lambertian direction characteristics, and the diffusion can only produce a limited effect.

In view of the above problems, the applicant of the present application previously filed an application for an improved LED lamp in which a light diffusing member is provided between the front side of the mounting substrate and the globe.

According to the invention previously filed, a portion of the light emitted from the LEDs is diffused (i.e. scattered) by the light diffusing member positioned ahead of the LEDs and radiated after passing through broader sections of the inner surface of the globe than before. As a result, the light distribution characteristics is improved.

[Citation List]

[Patent Literature]

[Patent Literature 1] Japanese Patent Application Publication No. 2009-037995.

[Patent Literature 2] Japanese Patent Application Publication No. 2010-086713.

SUMMARY OF INVENTION

[Technical Problem]

Although the previous invention provides an effect of improving the light distribution characteristics to a certain degree, there is still a need for further improvement. Accordingly, an objective of the present invention is to provide an LED lamp that is capable of producing an even more broader light distribution region. Another objective of the present invention is to provide an illumination device that includes such a LED lamp.

[Solution to Problem]

In order to achieve the above objective, an aspect of the present invention provides an LED lamp an LED lamp for emitting light outward through a globe, comprising: a plurality of LED modules composed of one main LED module and one or more auxiliary LED modules, each of the plurality of LED modules having a mounting substrate and LEDs mounted on the mounting substrate; a base through which power is supplied to the LEDs for light emission; and a light diffusing member, wherein the main LED module is positioned on an imaginary extension of a central axis of the base, and the light diffusing member is positioned inside the globe such that the main LED module emits light towards the light diffusing member, and the one or more auxiliary LED modules are positioned in a vicinity of the main LED module, with at least one of the one or more auxiliary LED modules tilted to face the light diffusing member.

According to the aspect of the present invention directed to an LED lamp, the LED lamp may be modified as follows. The main LED module is positioned such that the imaginary extension of the central axis of the base passes through a center of the main LED module, and the one or more auxiliary LED modules comprise at least two auxiliary LED modules which are arranged in rotational symmetry about the central axis of the base when viewed in a direction along the central axis.

Furthermore, the main LED module may emit a larger amount of light than any of the one or more auxiliary LED modules.

Furthermore, the light diffusing member may have a polyhedron shape.

Alternatively, the light diffusing member may be ring-shaped, positioned such that the imaginary extension of the central axis of the base passes through a center of the ring-shaped light diffusing member.

Moreover, LED lamp may further comprise a mount, wherein the plurality of LED modules are mounted on the mount, and the light diffusing member is supported by the mount via a supporting member.

Alternatively, the light diffusing member may be fixed to the globe.

In order to achieve the other objective, another aspect of the present invention provides an illumination device comprising: a lighting fixture; and an LED lamp according to claim 1 which is coupled to the lighting fixture.

[Advantageous Effects of Invention]

According to the LED lamp with the above structure, not only the main LED module positioned on the imaginary extension of the central axis of the base but also at least one of the one or more auxiliary LED modules face the light diffusing member. Accordingly, compared to a case where only a single LED module is provided (i.e. where all the LEDs emit light to a same direction), the amount of light diffused by the light diffusing member becomes larger. As a result, light passes through broader sections of the globe. Consequently, the light distribution range of the LED lamp becomes even more broader.

DESCRIPTION OF EMBODIMENTS

The following describes an embodiment of the present invention with reference to the drawings.

Figure 1A:
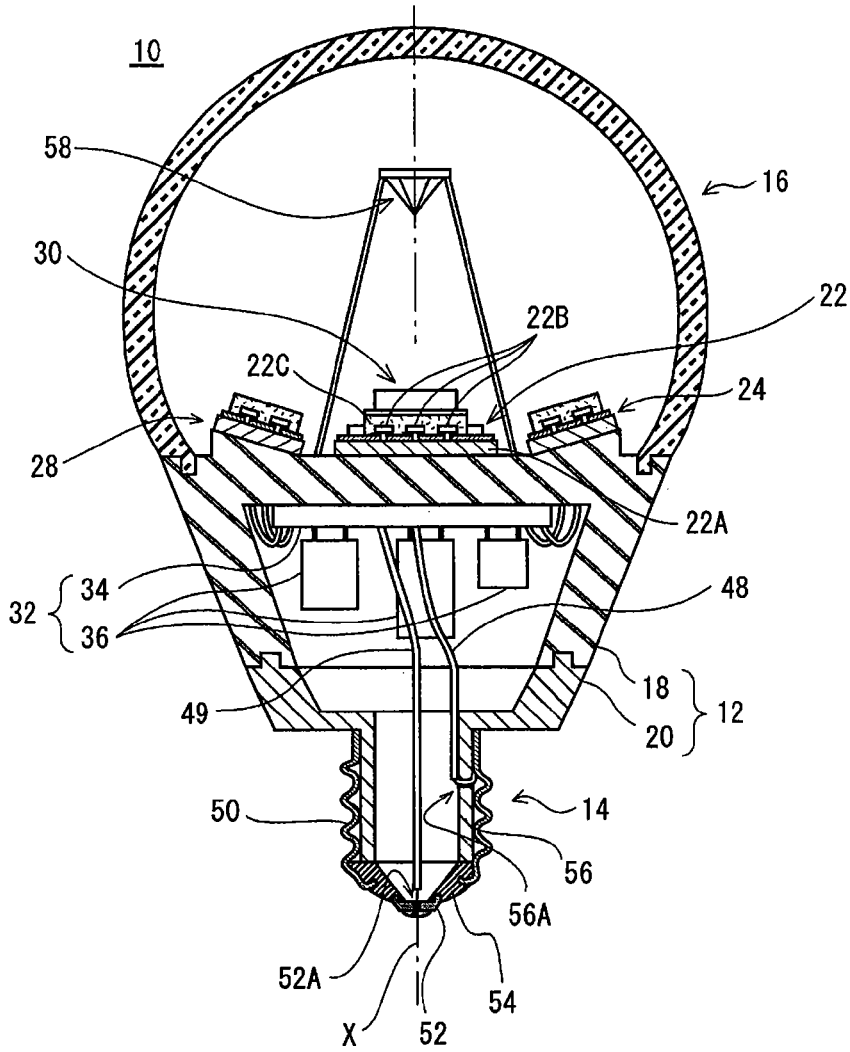
FIG. 1A is a cross-sectional view showing an overall structure of a bulb-type LED lamp.
Figure 2A:
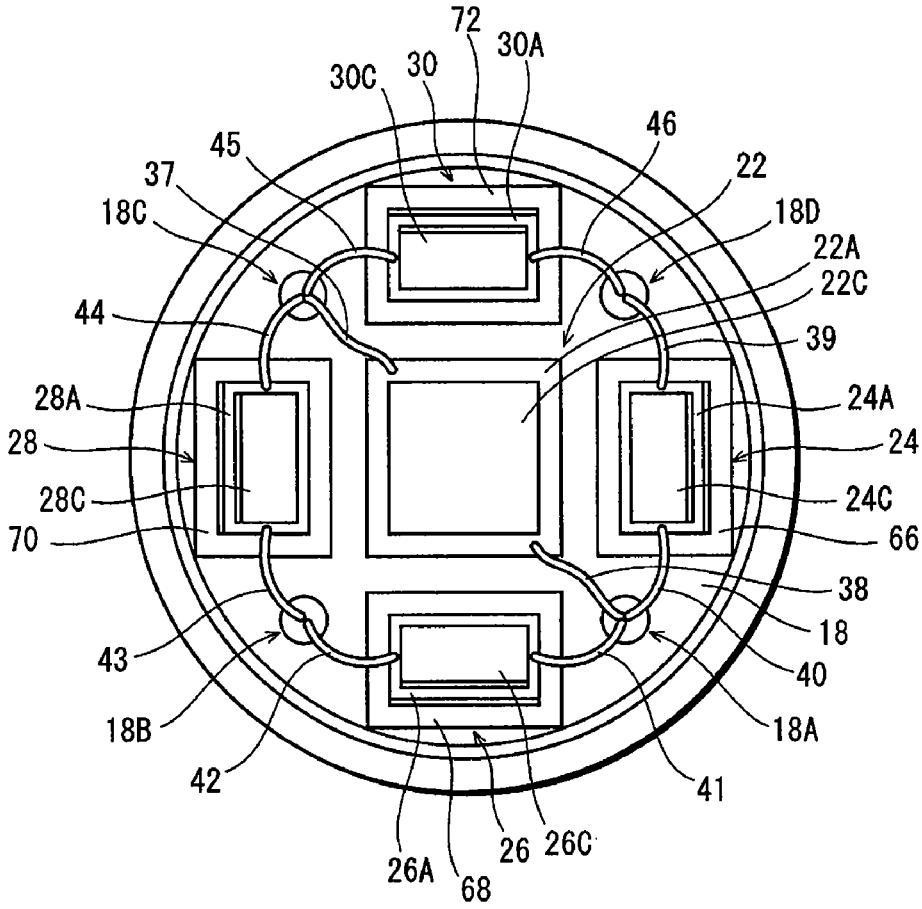
FIG. 2A is a plan view of the bulb-type LED lamp from which a globe is removed.

FIG. 1A is a cross-sectional view of a bulb-type LED lamp 10 (referred to below simply as an "LED lamp" 10), and FIG. 2A is a plan view of the LED lamp 10 from which a globe 16, which is described later, is removed. Note that the drawings inclusive of FIGS. 1A and 2A are not drawn to a common scale.

As shown in FIG. 1A, the LED lamp 10 includes a casing 12, a base 14 integrally attached to the casing 12, and a substantially semispherical shell-shaped globe 16 bonded to the casing 12. The globe 16 is made of a light-transmissive material such as a synthetic resin and a glass. The globe 16 is treated with blast treatment, or sprayed or applied with particles to obtain light scattering effects.

The casing 12 includes a metal portion 18 and a insulating portion 20. The metal portion 18 is made of, for example, aluminum, and doubles as a heat sink for dissipating heat emitted by LED modules 22, 24, 26, 28, 30 which are described later. The insulating portion 20 is made of epoxy resin or another kind of synthetic resin material.

Figure 2B:
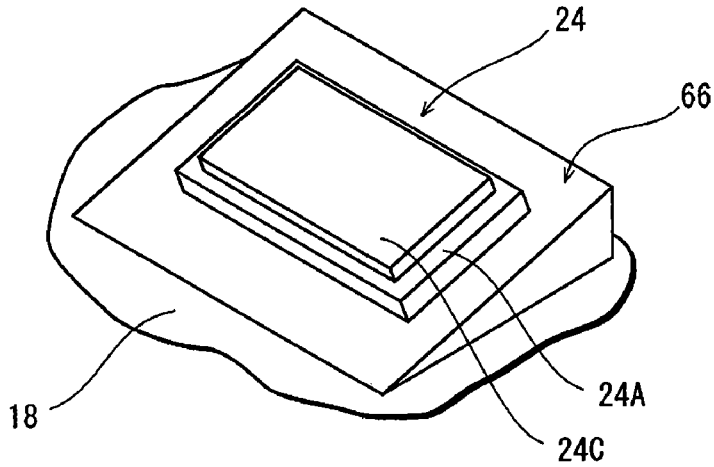
FIG. 2B is a partial perspective view of an LED module and the metal member.

The metal portion 18 has a circular truncated cone shape that is hollow. As shown in FIG. 2B, the LED modules 22, 24, 26, 28, 30 as light-emitting modules are mounted on an external bottom surface of the metal portion 18. In this way, the metal portion 18 also serves as a mount for the LED modules 22, 24, 26, 28, 30 to be mounted on.

The LED module 22, which is arranged in the middle among the five LED modules 22, 24, 26, 28, 30, has a square-shaped mounting substrate 22A on which nine blue LED chips 22B (not shown in FIG. 2A) are arranged in a matrix of 3 rows and 3 columns. These nine LED chips 22B are connected in series via a wiring line (not shown) on the mounting substrate 22A. A green phosphor film 22C is formed to cover all the nine LED chips. Thus, a white-color LED module 22 is formed.

Regarding the other LED modules 24, 26, 28, 30, the structure of these modules is basically the same as that of the LED module 22, except for a difference in the shape of mounting substrates 24A, 26A, 28A, 30A and the number of LED chips mounted thereon. Specifically, on each of the rectangle-shaped mounting substrates 24A, 26A, 28A, 30A, six blue LED chips (not shown) are arranged in a matrix of 2 rows and 3 columns, and respective green phosphor films 24C, 26C, 28C, 30C are formed to cover the six blue LED chips.

The LED module 22 is positioned such that the imaginary extension of a later-described central axis X passes through a center of the LED module 22, and the other LED modules 24, 26, 28, 30 are arranged in rotational symmetry about the central axis X when viewed in a direction along the central axis X.

Now, referring back to FIG. 1A, the metal portion 18 houses a lighting circuit unit 32 for lighting the LED modules 22, 24, 26, 28, 30. The lighting circuit unit 32 includes a printed wiring board 34, which is connected to an internal surface of the bottom of the metal portion 18, and a plurality of electronic parts 36, which are mounted on the printed wring board 34. The electronic parts 36 are electrically connected to the wiring pattern (e.g. lands) of the printed wiring board 34 by soldering. Also, the electronic parts 36 are electrically connected to each other via the wiring pattern, lead wires soldered to the printed wiring board 34, and the like. As shown in FIG. 2A, the LED modules 22, 24, 26, 28, 30 and the lighting circuit unit 32 are electrically connected to each other via internal wires 37, 38, 39, 40, 41, 42, 43, 44, 45, 46 inserted through through holes 18A, 18B, 18C, 18D provided at the bottom of the metal portion 18.

Referring to FIG. 1A again, the lighting circuit unit 32 converts commercial AC power, supplied from the base 14 via a first lead line 48 and a second lead line 49, into power for lighting the LED modules 22, 24, 26, 28, 30, and supplies the LED modules 22, 24, 26, 28, 30 with the converted power. Note that the first lead line 48 and the second lead line 49 are coated wire lines, and the coatings on both ends are partially stripped so that their internal lines are exposed.

The base 14 complies with the E26 base standards defined in JIS (Japanese Industrial Standards), for example, and is attachable to a socket (not shown) for conventional incandescent light bulbs.

The base 14 includes a shell 50, which is also referred to as a cylindrical body, and an eyelet 52 having a circular dish-like shape. The shell 50 and the eyelet 52 are integrated together, with a first insulating part 54 therebetween. The first insulating part 54 is made of a glass material. This integrated body is fit into a second insulating part 56 which extends from the casing 12 and has a cylindrical shape.

The second insulating part 56 is provided with a through hole 56A, and the first lead line 48 extends from the inside of the second insulating part 56 to the outside, via the through hole 56A.

The internal lead of the first lead line 48 at one end thereof is sandwiched between the internal surface of the shell 50 and the external surface of the second insulating part 56. Thus, the first lead line 48 and the shell 50 are electrically connected.

The eyelet 52 has a through hole 52A which is provided around the center thereof. The internal lead of the second lead line 49 extends to the outside through the through hole 52A, and connected to the external surface of the eyelet 50 by soldering.

Inside the globe 16A, a light diffusing member 58 is provided.

Figure 1B:
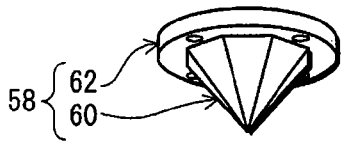
FIG. 1B is a perspective view of a light diffusing member.
Figure 1C:
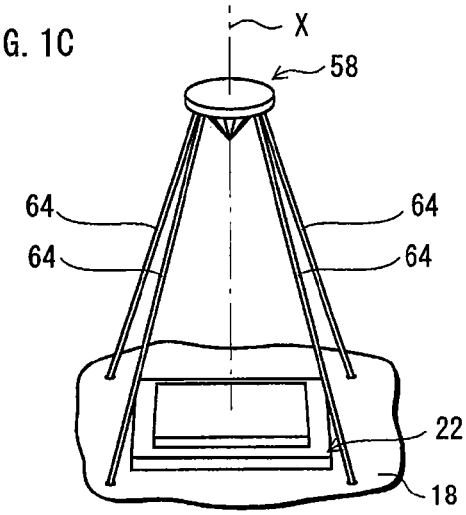
FIG. 1C is a view showing the light diffusing member supported by a metal member.

FIG. 1B is a perspective view looking at the light diffusing member 58 from obliquely below (i.e. from the metal portion 18). The light diffusing member 58 has a portion of a heptagonal pyramidal shape (referred to below as a "heptagonal pyramidal portion 60"), and a flange 62 integrally formed therewith such that the flange 62 is attached to a bottom of the octagonal cone. The light diffusing member 58 is made of, for example, a glass material. As shown in FIG. 1C, the light diffusing member 58 is supported on the metal portion 18 via four legs 64. Note that the material of the light diffusing member 58 is not limited to glass, and can be resin, metal, or ceramic. When a non-light-transmissive metal material and the like is used, a through hole is provided around the center of the light diffusing member 58 in order to obtain light passing through the center portion. Furthermore, the four legs 64 can be formed with a light-transmissive material in order to prevent a shadow from being formed on an object to be lit.

In the present example, the light diffusing member 58 is positioned on the imaginary extension of the central axis of the base 14 (note that the imaginary extension of the central axis is also referred to as central axis X below), and the middle LED module 22 among the five LED modules 22, 24, 26, 28, 30 is also positioned on the central axis X. In the present example, the LED module 22 is positioned such that the central axis X passes through the center (i.e. a point where two diagonal lines cross on a rectangular main surface, that is, a light-emitting surface of the green phosphor film 22C) of the LED module 22.

From among light that has been emitted by the LED module 22 and reached the light diffusing member 58, which is positioned face-to-face with the LED module 22, some light portions are reflected off the light diffusing member 58. The reflected light partly passes though some sections of the globe 16 near an opening thereof before being radiated outward. Accordingly, compared with a case without the light diffusing member 58, the LED lamp 10 is capable of distributing light over a broader range. Furthermore, the remaining portions of the light which has reached the light diffusing member 58 pass through the light diffusing member 58 and are radiated outward through the globe 16 as scattered light. Thus, with the light diffusing member 58 formed with the light-transmissive material, a shadow is prevented from being formed on an object to be lit to the maximum extent practicable.

Now, unlike the present example in which the plurality of LED modules are provided, assume a case where only a single LED module is provided (note that a total number of the LED chips remains same as the present example). Specifically, suppose that the single LED module (referred to below as a "comparative LED module") has a single mounting substrate on which LED chips are arranged in a matrix. In this case, light distributed by each LED chip exhibits the Lambertian characteristics to be directed strongly along a specific direction. Accordingly, only some of the LED chips arranged around the center of the mounting substrate can emit such intensive light that reaches the light diffusing member, and most of the light emitted by other LED chips mounted close to a periphery of the mounting substrate hits an inner surface of the globe without reaching the light diffusing member. As a result, the light emitted by the LED chips mounted around the periphery of the mounting substrate fails to contribute to production of a broader light distribution range of the LED lamp.

In contrast to the above case, in the present example, auxiliary LED modules are provided instead of the LED chips supposed to be mounted around the periphery of the mounting substrate in the comparative LED module. Furthermore, the auxiliary LED modules are arranged in a vicinity of (i.e. around) the LED module that is positioned to intersect the central axis X (i.e. positioned on the central axis X), while titled to face the light diffusing member. Note that the LED modules 24, 26, 28, 30 correspond to the auxiliary LED modules.

In order to tilt the LED modules 24, 26, 28, 30 as described above, the external bottom surface of the metal portion 18 is provided with inclined portions. A description is given of the LED module 24 as an example with reference to FIG. 2B.

The exterior bottom surface of the metal portion 18 is provided with an inclined portion 66 gradually sloping up towards the central axis X, and the LED module 24 is mounted on the inclined portion 66. Regarding a degree of inclination, the inclined portion 66 does not necessarily need to be inclined sufficiently such that the light diffusing member 58 is positioned exactly in front of the LED module 24. It is only necessary to incline the LED module 24 to let the light diffusing member 58 be within an angle of the light distribution range, providing that a normal to the mounting substrate 24A, which passes through the center of the LED module 24, forms an angle of 0 degree. With the above structure, the amount of light delivered to the light diffusing member 58 becomes larger compared to the case in the comparative LED module.

Note that the other LED modules 26, 28, 30 are also provided with inclined portions 68, 70, 72, respectively, and the LED modules 26, 28, 30 are mounted on the inclined portions 68. 70, 72, respectively.

Regarding a relative size of the light diffusing member 58 with respect to the LED module 22, it is preferable that in the plan view the light diffusing member 58 is smaller than the main light-emitting surface (i.e. an upper surface of the phosphor film 22C in FIG. 1) of the LED module 22. The reason is that, if the light diffusing member 58 is larger than the main light-emitting surface, the amount of light radiated forward from the LED lamp 10 becomes smaller, which is not preferable in terms of light distribution characteristics.

According to the LED lamp 10 with the above structure, since the light diffusing member 58 is positioned face-to-face with the main LED module 22 which emits light in the direction of the central axis X, and the LED modules 24, 26, 28, 30 are provided around the LED module 22 to be titled to face the light diffusing member 58, the amount of light delivered to the light diffusing member 58 becomes larger compared to the case in the above-described comparative LED module due to presence of the LED modules 24, 26, 28, 30. Consequently, the amount of light reflected off the light diffusing member 58 and bounced obliquely backward towards the base 14 is increased, whereby the light distribution range of the LED lamp 10 becomes broader.

Note that not all the LED modules 24, 26, 28, 30 need to be tilted, and the light distribution characteristics can be improved than the comparative LED module by making at least one of the LED modules 24, 26, 28, 30 tilted.

The present invention is described above based on the embodiment. However, of course the present invention is not limited to the embodiment above. For example, the following modifications can be made.

<Position of Light Diffusing Member>

Figure 3:
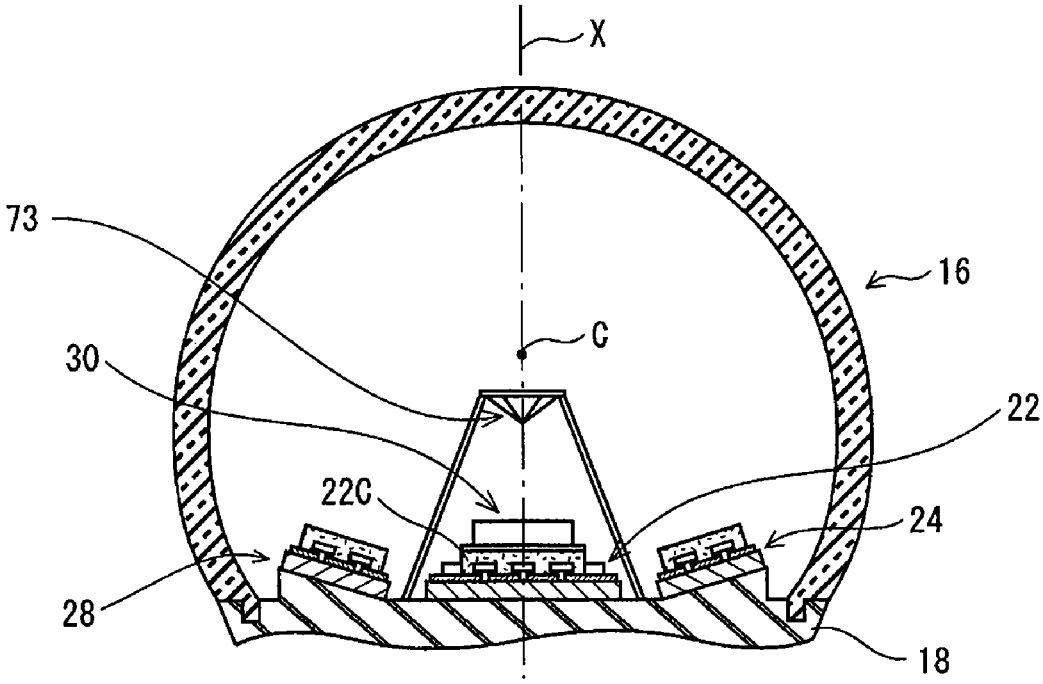
FIG. 3 shows a modification example in which the light diffusing member is positioned differently.

In the above embodiment, as can be seen from FIG. 1A, the light diffusing member 58 is positioned closer to the inner surface of the globe relative to a central point (referred to below as a "globe center") located between a bottom surface (which coincides with the surface of the metal portion 18 on which the LED modules are mounted) of the mounting substrate 22A in the LED module 22 and the inner surface of the globe. The above positioning method is to locate the light diffusing member 58 at a moderate distance from the LED module in order to improve the light distribution characteristics. However, as the light diffusing member 58 approaches closer to the inner surface of the globe, there is an increasing risk that the amount of light passing through the central axis X and some sections of the globe 16 around the central axis X might be lowered. To address the problem, a through hole may be provided in the light diffusing member 58 on and along the central axis X so as to increase the amount of light which is otherwise low. Alternatively, a structure shown in FIG. 3 may be adopted.

That is to say, the light diffusing member 73 may be positioned closer to the LED module 22 relative to the globe center C.

Adopting the above structures helps prevent a decrease in the amount of light passing through the central axis X and some sections of the globe 16 around the central axis X.

However, in some cases, the mounting substrate is so thick that the rectangular main surface (i.e. light-emitting surface) of the phosphor film 22C is at an unnecessarily far distance from the surface of the metal portion 18 (i.e. the surface on which the LED modules are mounted). In such a case, the globe center may be defined to be a central point on the central axis .X located between the rectangular main surface of the phosphor film 22C and the inner surface of the globe 16.

<Shape of Light Diffusing Member>

Although in the above embodiment the main portion of the light diffusing member 58 is shaped in the heptagonal pyramid, the present invention is not limited to the above embodiment. For example, the following modifications are considered.

Figure 4A:
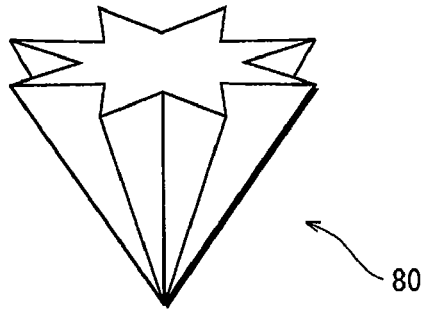
FIGS. 4A, 4B, and 4C are perspective views each showing a different modification example of the light diffusing member.

As shown in FIG. 4A, a light diffusing member 80 in the shape of star pyramid may be deployed.

Figure 4B:
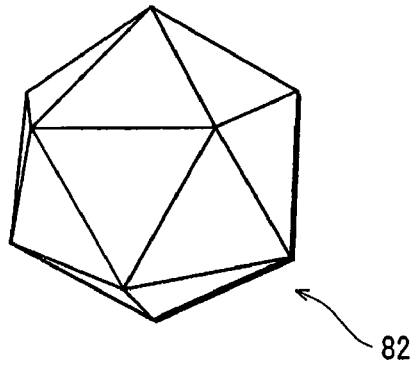

As shown in FIG. 4B, a light diffusing member 82 in the shape of icosahedron, as an example of regular polyhedral, may also be deployed.

Figure 4C:
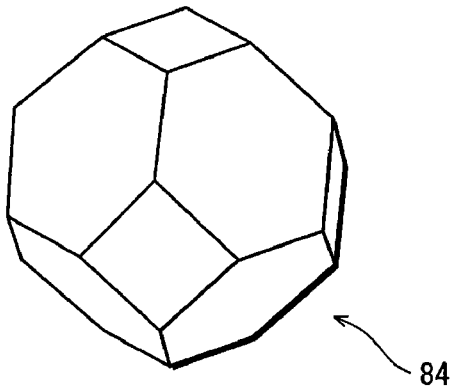

As shown in FIG. 4C, a light diffusing member 84 in the shape of truncated octahedron, as an example of parallelohedra, may also be deployed.

Figure 5A:
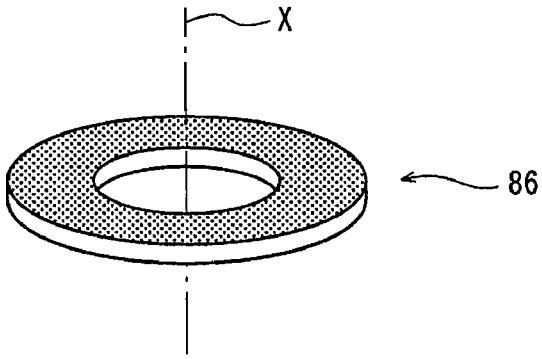
FIG. 5A is a perspective view of another modification example of the light diffusing member.

Alternatively, as shown in FIG. 5A, a ring-shaped light diffusing member 86 may be deployed. When positioned such that the central axis X passes through a center of a hollow portion of the ring, the light diffusing member 86 allows the most intensive light ray from the LED module 22 to pass through the hollow portion to be delivered to the (top of the) globe 16. As a result, the peripheral light rays are reflected off the light diffusing member 86 and bounced obliquely backward towards the base 14.

Figure 5B:
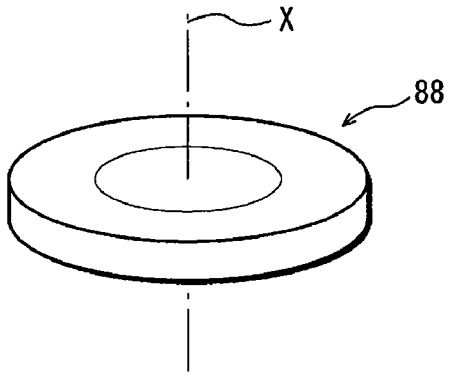
FIG. 5B is a perspective view of yet another modification example of the light diffusing member.
Figure 5C:
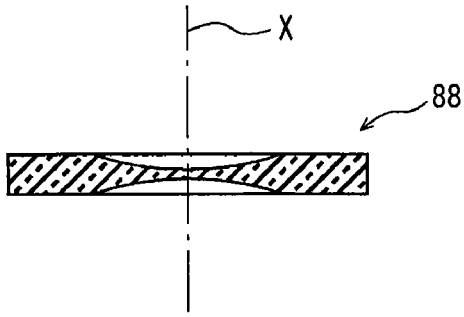
FIG. 5C is a cross-sectional view of the light diffusing member of FIG. 5B.

Note that as shown in FIGS. 5B and 5C a light diffusing member 88 of a concave disc shape, instead of the ring shape, may also be deployed. When positioned such that the central axis X passes through a center of a concave portion of the concave disc, the light diffusing member 88 similarly allows the most intensive light ray from the LED module 22 to pass through the concave portion to be delivered to the (top of the) globe 16. As a result, the peripheral light rays are reflected off the light diffusing member 88 and bounced obliquely backward towards the base 14.

<Supporting Method of Light Diffusing Member>

Although in the above embodiment the light diffusing member 58 is supported by the four legs 64 on the metal portion 18 within the globe 16, the light diffusing member 58 may be provided within the globe 16 according to another method.

Figure 6:
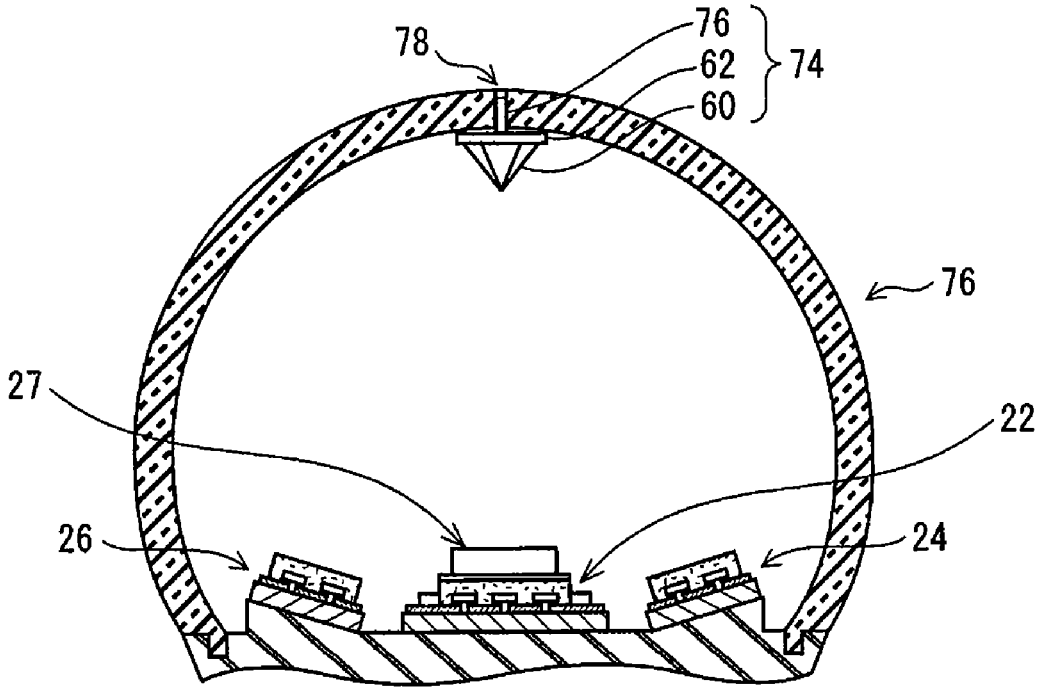
FIG. 6 is a partial cross-sectional view of the bulb-type LED lamp according to another modification example.

For example, as shown in FIG. 6, a light diffusing member 74 may be fixed to the globe 16. In the light diffusing member 74 of the present example, a shaft 76 is provided to stand on the flange 62, and a through hole 78 is formed at the top of the globe 76. The light diffusing member 74 is fixed to the globe 76 by inserting and bonding the shaft 76 to the through hole 78.

Figure 7A:
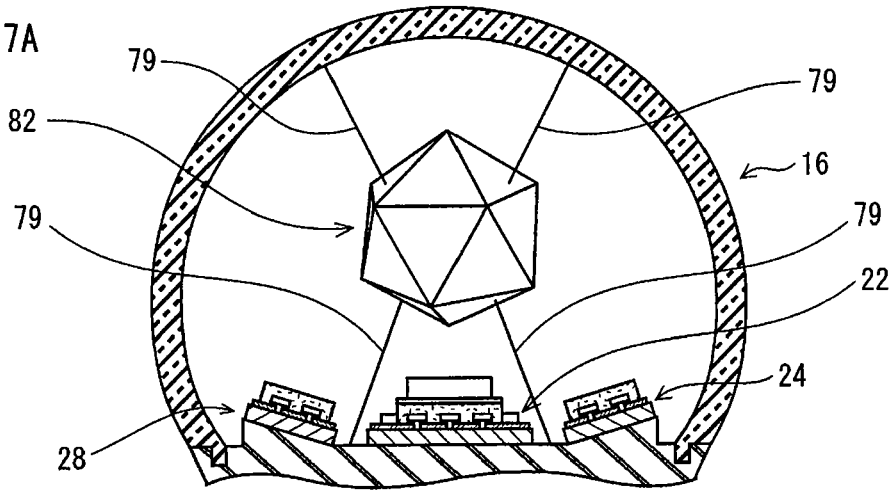
FIGS. 7A, 7B, and 7C are partial cross-sectional views each showing the bulb-type LED lamp according to a different modification example.

Furthermore, as shown in FIG. 7A, regarding the light diffusing members of a cubic (i.e. polyhedral) structure shown in FIGS. 4B and 4C, it is also possible to immovably fix the light diffusing members inside the globe 16 by holding them in various directions under tension of a plurality of light-transmissive thin wires 79.

Figure 7B:
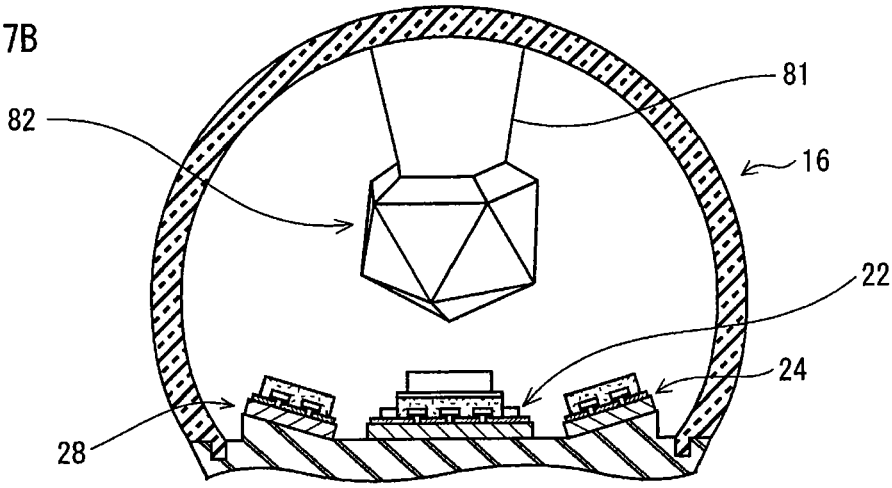

Moreover, as shown in FIG. 7B, the light diffusing member 82 may be fixed using a light-transmissive mount 81 hang from a ceiling portion of the inner surface of the globe 16. This method may also be applied to the light diffusing member 84 (of FIG. 4C).

Figure 7C:
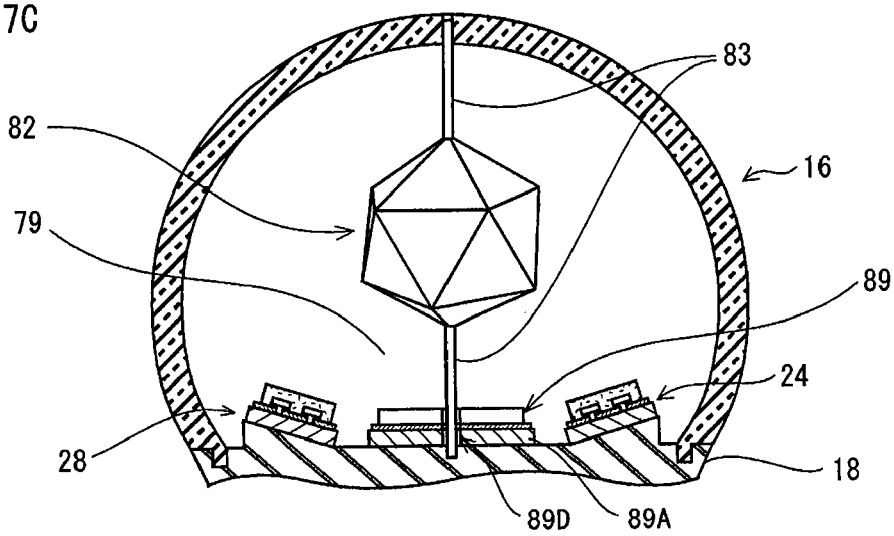

Moreover, as shown in FIG. 7C, the light diffusing member 82 may be fixed using a light-transmissive column 83 between the inner surface of the globe 16 and the metal portion 18. In this case, an LED module 89 is mounted in place of the LED module 22. The LED module 89 is different in arrangement of LED chips (not shown) than the above LED modules. That is to say, no LED chip is mounted around a center of the mounting substrate 89, and instead, a through hole 89D is formed there. The column 83 passes through the through hole 89D to be fixed to the metal portion 18.

<Plan-View Shape and Arrangement of LED Modules>

Figure 8A:
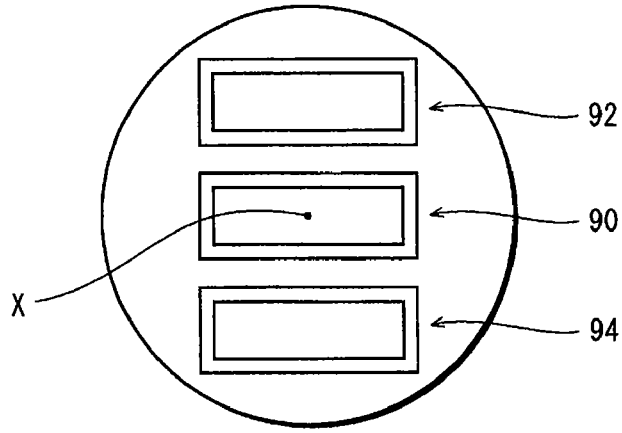
FIGS. 8A, 8B, and 8C are plan views each showing the bulb-type LED lamp according to a different modification example from which the globe is removed.

FIG. 8A shows LED modules 90, 92, 94 of an identical rectangular shape, where the LED modules 92, 94 are arranged in parallel on either side of the module 90 in the middle. In the present example, the LED module 90 is positioned such that the imaginary extension of the central axis X passes through a center of the LED module 90, and the other LED modules 92, 94 are arranged in rotational symmetry about the central axis X when viewed in the direction along the central axis X. Although simplified in FIG. 8A, each of the LED module 92 and the LED module 94 is tilted towards the central axis X (i.e. to face the light diffusing member 58).

Figure 8B:
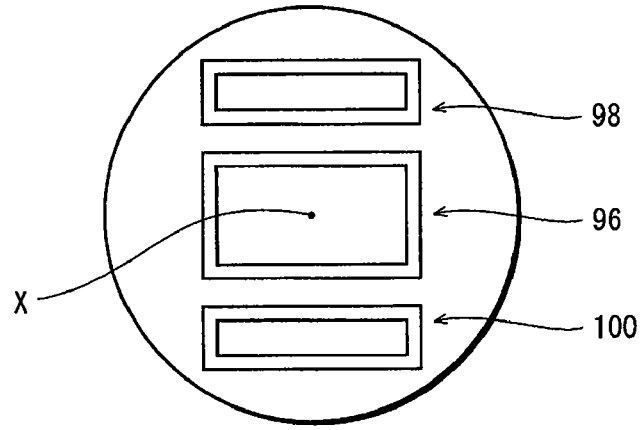

In addition to the case of FIG. 8A where the three LED modules have the same size (i.e. same light-emitting area size on the phosphor film), FIG. 8B shows another example where the size of a LED module 96 in the middle is increased and the size of each of LED modules 98, 100 arranged in the vicinity of (on either side) the middle LED module 96 is decreased to create a difference in light-emitting area size. Needless to say, each of the LED modules 98, 100 is tilted towards the central axis X (to face the light diffusing member 58).

Figure 8C:
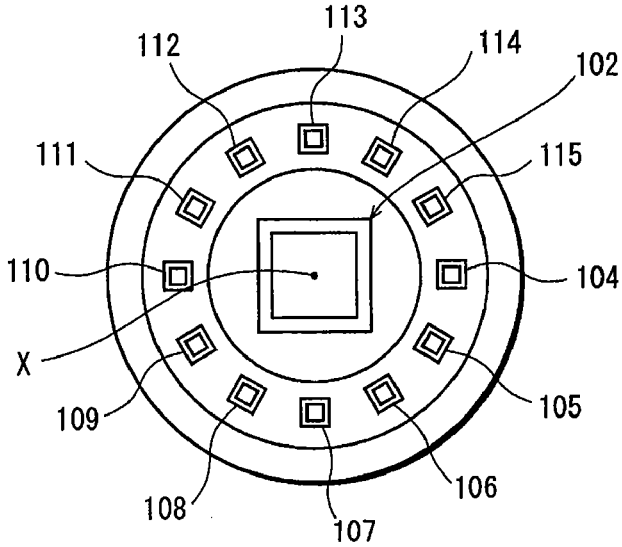

FIG. 8C shows yet another example where small LED modules 104-115 are arranged around a LED module 102 in the middle along a circumference of a circle around the central axis X. In the present example, the LED module 102 is positioned such that the imaginary extension of the central axis X passes through a center of the LED module 102, and the other LED modules 104-115 are arranged in rotational symmetry about the central axis X when viewed in the direction along the central axis X. Needless to say, each of the LED modules 104-115 is tilted towards the central axis X (to face the light diffusing member 58).

Note that the number of the LED modules arranged around the middle LED module is not limited to four (as in FIG. 2A), two (as in FIGS. 8A and 8B), and twelve (as in FIG. 8C), and may be appropriately modified. When the LED modules are arranged around the middle LED module in rotational symmetry about the central axis X, however, at least two LED modules are required to be arranged around the middle LED module. In this case, the number of the LED modules inclusive of the middle LED module totals three or more.

<Other Modifications>

Figure 9:
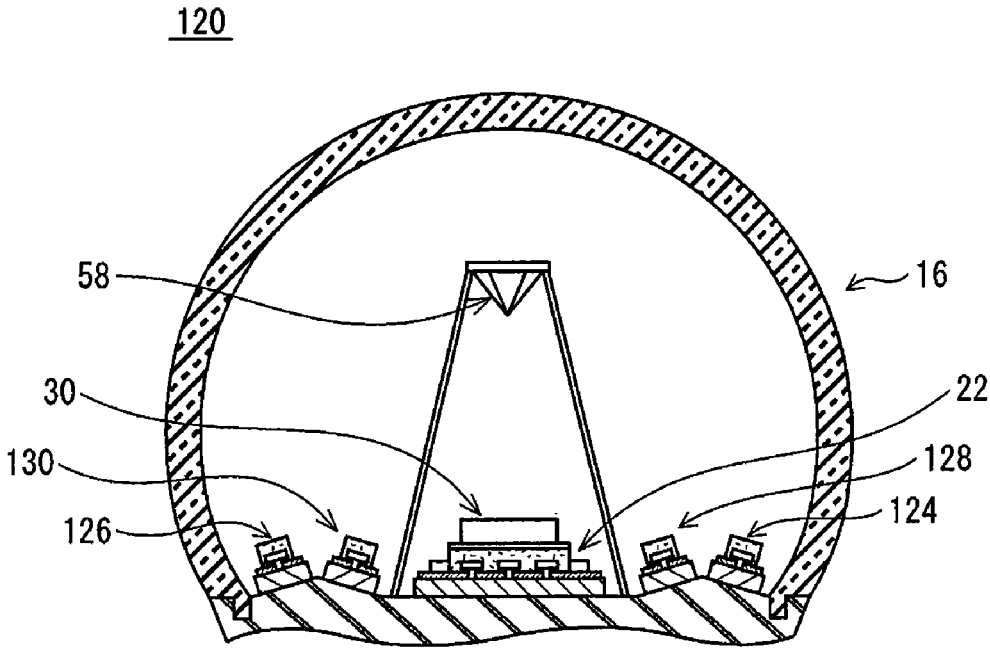
FIG. 9 is a partial cross-sectional view of the bulb-type LED lamp according to yet another modification example.

(1) Although in any of the above modification examples the LED modules are made to face the light diffusing member, LED modules positioned near opening edges of the globe may be tilted towards the opening edges. FIG. 9 shows a bulb-type LED lamp 120 with such a structure.

In an example of FIG. 9, the LED modules 24, 26 (28, 30) of the embodiment shown in FIG. 1A are each divided into two LED modules, and among the LED modules resulting from the division, LED modules 124, 126 positioned closer to the opening edges of the globe 16 are tilted towards the opening edges. Among the divided LED modules, LED modules 128, 130 positioned closer to the middle LED module 22 are tilted to face the light diffusing member 58, similarly to the case in the LED lamp 10 of the above embodiment.

With the above structure, the amount of light directly delivered from the LED modules 124, 126 to the opening edges of the globe 16 is increased, and accordingly the amount of light diffused by the opening edges and radiated from the globe 16 is increased. As a result, the light distribution range of the LED lamp 120 becomes even more broader.

Figure 10A:
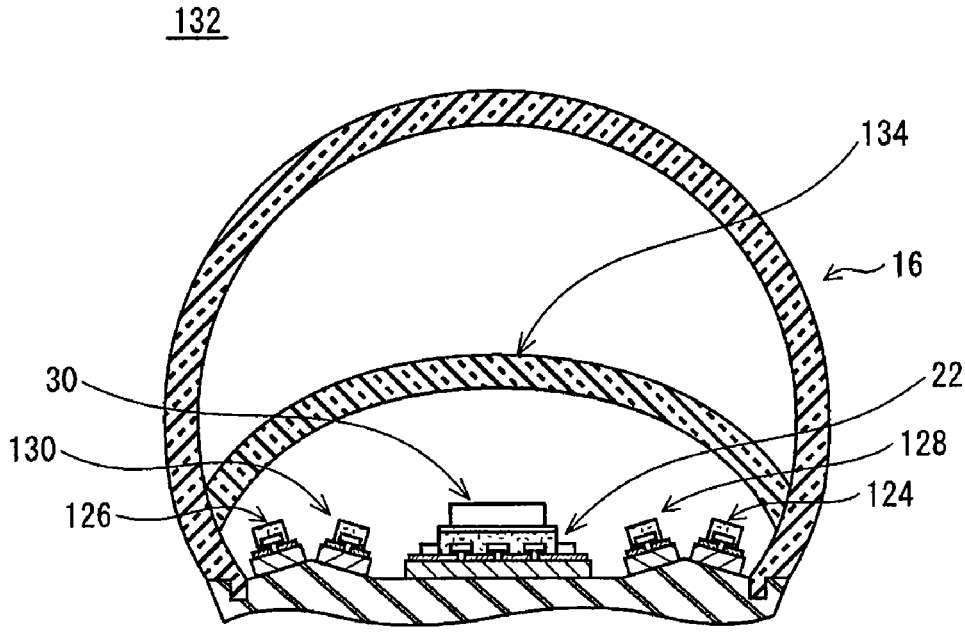
FIGS. 10A and 10B are partial cross-sectional views each showing the bulb-type LED lamp according to a different modification example.

(2) FIG. 10A shows as yet another example a bulb-type LED lamp 132 in which a dome-shaped light diffusing film 134 is provided within the globe 16 in place of the light diffusing member 58 of the above-described bulb-type LED lamp 120 (of FIG. 9). The light diffusing film 134 is made of, for example, a plastic bead light-diffusing material, polycarbonate, polyester film, and acrylic urethane. The light diffusing film 134 serves to reflect off or let through the light emitted by the LED modules 22, 30, 124, 126, 128, 130, . . . depending on the respective incident angles of the light. With the above structure, compared with a case without the light diffusing film 134, the light from the LED modules is delivered to broader sections of the inner surface of the globe 16. As a result, the light distribution range of the LED lamp 132 becomes even more broader.

Figure 10B:
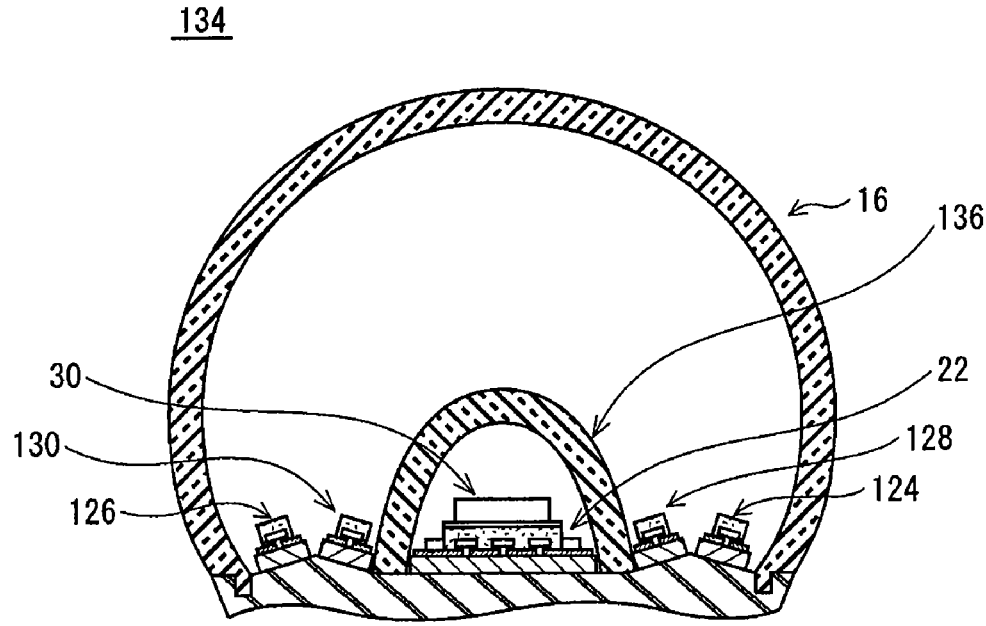

Here, as shown in FIG. 10B as a bulb-type LED lamp 134, a light diffusing film 136 may also be employed which covers only a part of the LED modules (e.g. LED module 22 in the present example).

<Illumination Device>

Figure 11:
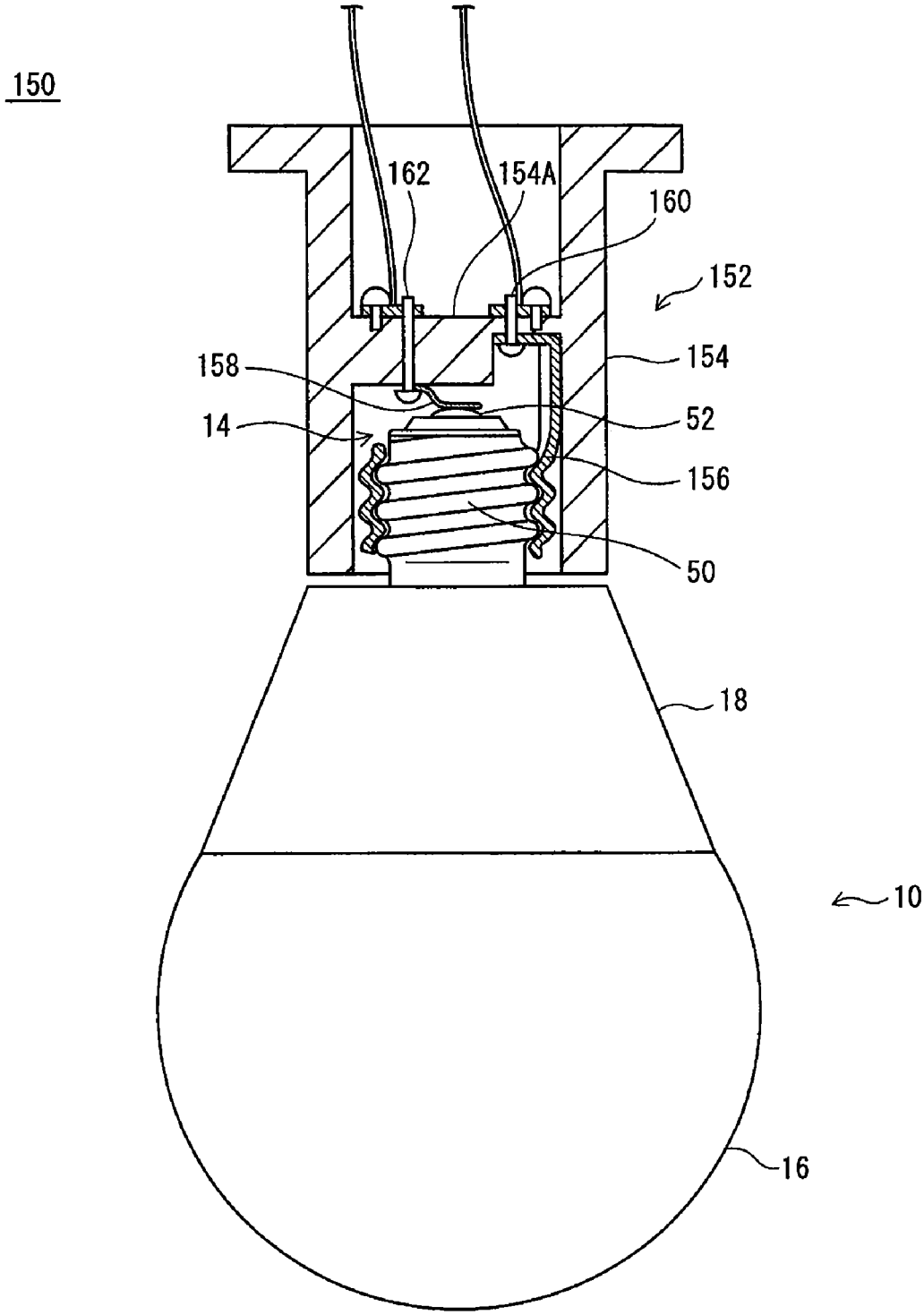
FIG. 11 is a view showing an overall structure of an illumination device.

FIG. 11 shows an illumination device 150 including the LED lamp 10. FIG. 11 is a cross-sectional view of a lighting fixture 152 constituting the illumination device 150.

The lighting fixture 152 can be ceiling-mounted small-size lighting fixture that is attachable to a ceiling, wall, and the like.

The lighting fixture 152 includes an outer frame 154, a shell bearing 156 housed in the outer frame 154, and an eyelet piece 158.

The outer frame 154 is made of an insulating material such as heat-resistant plastic, and shaped in a cylinder partitioned almost in the middle in a longitudinal direction of the outer frame 154.

The bearing shell 156 includes a cylindrical female screw, and fixed to a partition wall 154A of the outer frame 154 by a screw 160.

The eyelet piece 158 is formed by bending a strip of metal, and fixed to the partition wall 154A by a screw 162 as well.

By screw-fitting the base 14 (of FIG. 1) onto the lighting fixture 152 with the above structure, the LED lamp 10 is mounted to the lighting fixture 152. Thus, the illumination device 150 is formed.

[Industrial Applicability]

A bulb-type LED lamp according to the present invention is suitable as a substitute for an incandescent light bulb, for example.

[Reference Signs List]

10 bulb-type LED lamp
14 base
16 globe
22, 24, 26, 28, 30, 90, 92, 94, 96, 100, 102, 105, 106, 107, 108, 109, 110, 111, 112, 113, 114, 115 LED module
58, 74, 80, 82, 84, 86, 88 light diffusing member

The invention claimed is:

1. An LED lamp for emitting light outward through a globe, comprising:
- a plurality of LED modules composed of one main LED module and one or more auxiliary LED modules, each of the plurality of LED modules having a mounting substrate and LEDs mounted on the mounting substrate;
- a base through which power is supplied to the LEDs for light emission; and
- a light diffusing member, wherein
- the main LED module is positioned on an imaginary extension of a central axis of the base, and the light diffusing member is positioned inside the globe such that the main LED module emits light towards the light diffusing member, and
- the one or more auxiliary LED modules are positioned in a vicinity of the main LED module, with at least one of the one or more auxiliary LED modules tilted to face the light diffusing member.

2. The LED lamp of claim 1, wherein
- the main LED module is positioned such that the imaginary extension of the central axis of the base passes through a center of the main LED module, and
- the one or more auxiliary LED modules comprise at least two auxiliary LED modules which are arranged in rotational symmetry about the central axis of the base when viewed in a direction along the central axis.

3. The LED lamp of claim 1, wherein
- the main LED module emits a larger amount of light than any of the one or more auxiliary LED modules.

4. The LED lamp of claim 1, wherein
- the light diffusing member has a polyhedron shape.

5. The LED lamp of claim 1, wherein
- the light diffusing member is ring-shaped, positioned such that the imaginary extension of the central axis of the base passes through a center of the ring-shaped light diffusing member.

6. The LED lamp of claim 1, further comprising:
- a mount, wherein
- the plurality of LED modules are mounted on the mount, and the light diffusing member is supported by the mount via a supporting member.

7. The LED lamp of claim 1, wherein
- the light diffusing member is fixed to the globe.

8. An illumination device comprising:
- a lighting fixture; and
- an LED lamp according to claim 1 which is coupled to the lighting fixture.

* * * * *